US005493318A

United States Patent [19]

Negoro et al.

[11] Patent Number: 5,493,318

[45] Date of Patent: Feb. 20, 1996

[54] CONTINUOUS FORM POSITIONING DEVICE WITH CONTROL OF ROLLERS IN RESPONSE TO A TIP SENSOR

[75] Inventors: Ikuo Negoro; Kiyoshi Negishi; Masahiro Kita, all of Tokyo, Japan

[73] Assignee: Asahi Kogaku Kogyo Kabushiki Kaisha, Tokyo, Japan

[21] Appl. No.: 120,237

[22] Filed: Sep. 14, 1993

Related U.S. Application Data

[63] Continuation of Ser. No. 436,027, Nov. 14, 1989, abandoned.

[30] Foreign Application Priority Data

Nov. 14, 1988 [JP] Japan ..... 63-286995

[51] Int. Cl.[6] ..... G01D 15/24; B41J 2/44; B41J 11/42; B65H 23/04

[52] U.S. Cl. ..... 346/136; 347/139; 226/27; 400/583

[58] Field of Search ..... 346/108, 136, 346/160; 226/27, 28, 12, 91, 10, 24; 340/675; 355/317, 285; 400/578, 582, 583, 611, 613.1; 347/139, 262, 264

[56] References Cited

U.S. PATENT DOCUMENTS

| | | | |
|---|---|---|---|
| 3,734,604 | 5/1973 | Szostak et al. | 340/675 |
| 4,560,995 | 12/1985 | Suga et al. | 346/136 |
| 4,881,086 | 11/1989 | Misawa | 346/108 |
| 4,912,490 | 3/1990 | Negoro et al. | 346/160 |
| 4,924,266 | 5/1990 | Negoro et al. | 226/27 |
| 4,963,941 | 10/1990 | Negishi et al. . | |
| 4,998,835 | 3/1991 | Negishi et al. . | |
| 5,023,631 | 6/1991 | Negishi et al. . | |
| 5,023,667 | 6/1991 | Negoro et al. . | |
| 5,027,135 | 6/1991 | Negishi et al. . | |
| 5,105,227 | 4/1992 | Kitamura et al. . | |

FOREIGN PATENT DOCUMENTS

| | | | |
|---|---|---|---|
| 0348953 | 1/1990 | European Pat. Off. . | |
| 2734314 | 2/1978 | Germany . | |
| 3811413 | 10/1988 | Germany . | |
| 3811414 | 10/1988 | Germany . | |
| 59-39584 | 3/1984 | Japan . | |
| 62-233276 | 10/1987 | Japan . | |
| 62-248650 | 10/1987 | Japan . | |
| 0104555 | 4/1989 | Japan | 226/27 |

OTHER PUBLICATIONS

English Language Abstracts of JP 62–248650 and JP 59–39584.

*Primary Examiner*—Benjamin R. Fuller
*Assistant Examiner*—David Yockey
*Attorney, Agent, or Firm*—Sandler, Greenblum & Bernstein

[57] ABSTRACT

A device for positioning a tip portion of a continuous form provided in a laser printer when the continuous form is set in the laser printer. The device includes a pair of fixing rollers provided at a position separated by a predetermined interval from a photosensitive drum, a tractor unit, a feed sensor, a tip sensor, and a control unit. The tractor unit is provided between the fixing rollers and the photosensitive drum to feed the continuous form toward the fixing rollers, the feed sensor outputs feed pulses in accordance with an amount fed of the continuous form, the tip sensor senses the tip portion of the continuous form. The control unit counts the number of feed pulses sensed by the feed sensor to feed one page of the continuous form so as, to discharge one page from the outlet mouth of the printer when a positioning of the tip portion is needed.

22 Claims, 11 Drawing Sheets

CONTINUOUS FORM POSITIONING DEVICE WITH CONTROL OF ROLLERS IN RESPONSE TO A TIP SENSOR

This application is a continuation of application No. 07/436,027, filed Nov. 14, 1989, now abandoned.

BACKGROUND OF THE INVENTION

1. Field of the Invention

The present invention relates to a device for correctly positioning a tip portion of a continuous form provided in a laser printer.

2. Description of the Related Art

In the operation of known laser printers, a sensitive drum is rotated in a sub-scanning direction while a laser beam is scanned along a main scanning direction, whereby a latent image to be printed is formed on the photosensitive drum, and the latent image is then transferred to a continuous form (fan-fold paper) fed along the sub-scanning direction. In this type of printer, the image transferred to the continuous form is fixed by a pair of fixing rollers disposed at a position apart by a predetermined interval from the photosensitive drum along the direction in which the continuous form is fed, and the printed continuous form is then discharged from the printer.

In this kind of laser printer, a printing process is carried out for each one page, and thus the space between the photosensitive drum and a pair of fixing rollers is set to correspond to a single page of the continuous form, and the printing of the form is carried out in such a manner that images as printed are aligned with ruled lines on the continuous form. Therefore, when the continuous form is fed in the laser printer, the tip portion of the continuous form must be forwarded and positioned so that the continuous form is set to a predetermined position. Accordingly, a tip sensor for sensing a position of the tip portion of the continuous form is provided at a point midway in a passage through which the continuous form is fed and near the fixing rollers.

When, however, a new continuous form is set to the printer, and the tip portion of the continuous form is positioned when the temperature of the fixing rollers waiting for a next printing process is high, since the tip portion of the continuous form is located approximately just under a heat roller of the fixing rollers, the tip portion is heated by the heat roller, and thus is curled, deteriorated in quality, and often burnt, and accordingly, a paper jam is apt to occur.

SUMMARY OF THE INVENTION

Therefore, an object of the present invention is to provide a positioning device by which, when a tip portion of a continuous form is positioned, curling, deteriorations in quality, and burning of a continuous form are prevented, and thus a paper jam occurring when feeding the tip portion to position same is avoided.

According to the present invention, there is provided a positioning device comprising a pair of fixing rollers for feeding a continuous form while fixing a printed image transferred to the continuous form, means for feeding the continuous form, a feed sensor for sensing the amount fed of the continuous form, a tip sensor for sensing a position of a tip portion of the continuous form, and means for controlling the fixing rollers.

As in the known laser printer, a photosensitive drum is provided on which a printing image is exposed and by which the printed image is transferred to the continuous form, and fixing rollers are provided at a position separated from the photosensitive drum by a predetermined interval along a direction in which the continuous form is fed. A feeding means is provided between the sensitive drum and the fixing rollers, and a feed sensor is rotated in association with the feeding means to output a feeding pulse upon the feeding of a predetermined amount of the continuous form. Based on an output of a tip sensor, a control means determines whether or not the tip portion of the continuous form needs positioning, and when a positioning of the tip position is needed, the control means rotates the fixing rollers in accordance with the number of feeding pulses output, to feed approximately one page of the continuous form, and then stops the rotation of the fixing rollers.

BRIEF DESCRIPTION OF THE DRAWINGS

The present invention will be better understood from the description of the preferred embodiments of the invention set forth below, together with the accompanying drawings, in which.

DESCRIPTION OF THE PREFERRED EMBODIMENTS

Figure 1:
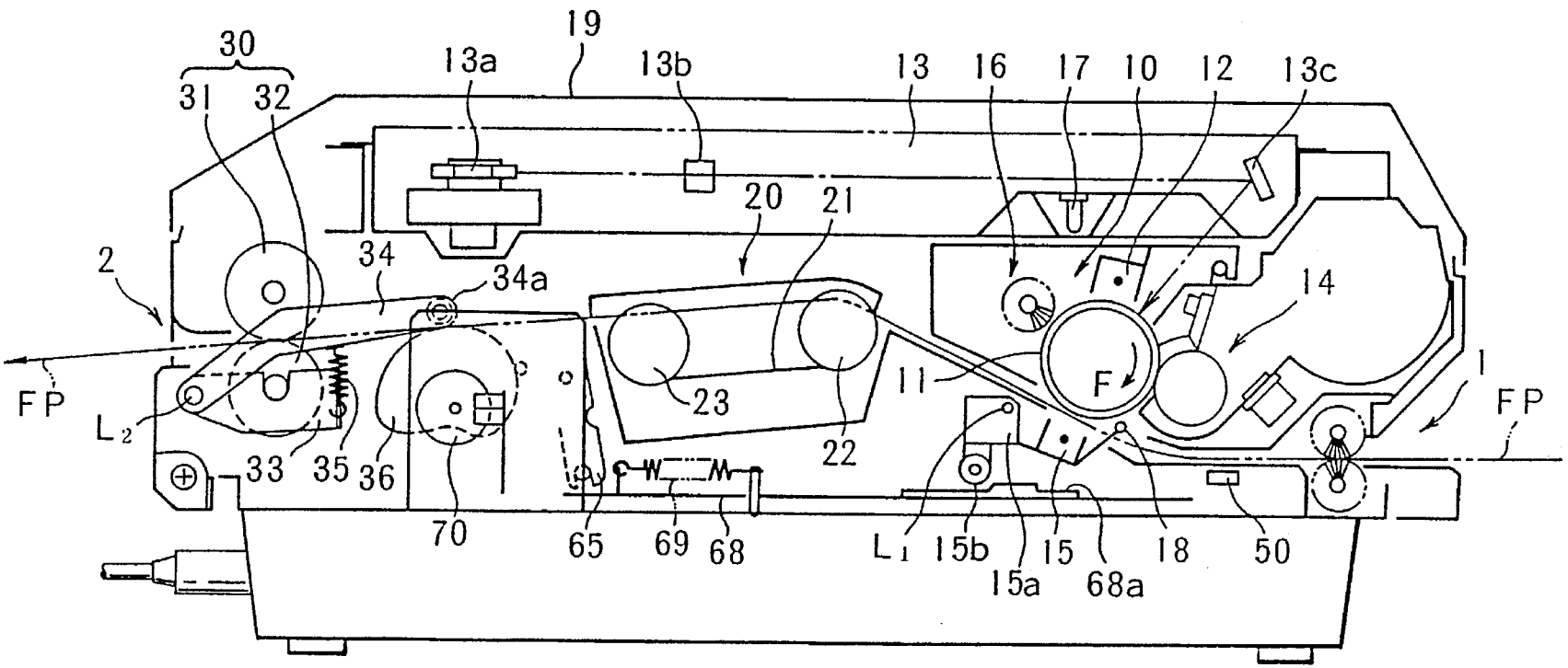
FIG. 1 is a side view of a laser printer to which an embodiment of the present invention is applied.

The present invention will now be described with reference to embodiments shown in the drawings.

FIGS. 1 through 5 show an embodiment of a device for feeding a continuous form provided in a laser beam printer, in which the continuous form is printed, in accordance with print data input from a host computer, by an electrophotographing process which includes an exposure to a photosensitive drum, developing of the exposed image, and a transfer and a fixing thereof on a page of the continuous form. Note that, although this printer is similar to a conventional dot matrix type line printer which starts a printing process by accumulating printing data for one line, since this description is concerned with the use of a continuous form, and as the printing is carried out by the electrophotographing process, as described above, this printer is constructed as a page printer which starts printing after accumulating print data corresponding to one full page of printing.

The mechanical construction of the printer is described below with reference to FIGS. 1 through 5.

From an inlet mouth 1 through which a continuous form FP is supplied, to an outlet mouth 2 through which a printed form is discharged, the printer is provided with a transfer unit 10 centered around a photosensitive drum 11, a tractor unit 20 including endless belts 21 having projections engaging with sprocket holes of a continuous form FP, and a fixing unit 30 including a pair of rollers 31 and 32 for thermofixing a toner image transferred to the form, in that order.

The transfer unit 10 includes a charger 12 for charging a photosensitive material on the photosensitive drum 11 with electricity, a scanning optical system 13 for exposing the charged photosensitive material to form an electrostatic latent image on the drum 11, a developing unit 14 for applying a toner to the formed latent image, an electrical discharge unit 15 for charging the continuous form FP to transfer the toner image thereto, a cleaning brush 16 for removing toner remaining on the drum 11, and an LED 17 for exposing the whole surface of the drum 11 to radiation to remove residual electric charges from the drum 11. The photosensitive drum 11 is rotated in a direction F as shown in FIG. 1, so that the latent image is developed as a toner image by the developing unit 14, and then transferred to the continuous form FP by the transfer unit 10. The printed image transferred to the continuous form FP is then fixed by the fixing unit 30.

A scanning system 13 is disposed in an upper cover 19 of the printer. In the scanning system 13, a modulated beam from a semiconductor laser (not shown) is continuously deflected by a polygon mirror 13*a*, and is converged by an fϕ lens 13*b*. The converged beam is reflected by a beam bender 13*c* to form a scanning line on the photosensitive drum 11, which rotates so that an electrostatic latent image is formed on the photosensitive drum 11 in the form of dots.

The electrical discharge unit 15 is fixed to an arm 15*a* which is rotated about a pivot L1 by a cam mechanism described later. A paper pressing roller 18 is connected to the arm 15*a*, at an opposite end thereof to the electrical discharge unit 15, and the continuous form FP is passed between the paper pressing roller 18 and the end portion of the arm 15*a*. The arm 15*a* is also provided with a cam follower 15*b*.

When using the continuous form FP, if the entire transferred part thereof is fixed, a part of the continuous form FP between the transfer position and the fixing position is left blank and discharged at the start of the next printing process, and thus is wasted. Therefore, when the printing process is temporarily stopped, a problem arises of what part of the transferred continuous form FP should be fixed. Further, taking into consideration the printing performance of the printer, an interruption and a restart of the transfer and fixing process are preferably carried out at the perforated portion of the continuous form FP at which the forms are separated from each other. Accordingly, the printer of this embodiment is constructed in such a manner that a space between the transfer position and the fixing position corresponds to one page of the continuous form FP, and when the printing is stopped, a perforated portion thereof, which is a boundary between two adjacent pages, is at the transfer position or the fixing position.

When the printing is restarted, the drum 11 must be allowed to run idle, so that the continuous form FP is not fed, until an exposure part of the drum reaches the transfer position of the continuous form FP. Note that, if the drum 11 is rotated while the continuous form FP and the drum 11 are in contact with each other, the life of the drum 11 is shortened due to an abrasion of the sensitive material thereon, and the continuous form FP is stained by a residual toner. Therefore, to avoid these problems, the printer is constructed in such a manner that when the drum 11 is running idle, the arm 15*a* is depressed so that the paper pressing roller 18 depresses an upper surface of the continuous form FP, to separate the continuous form FP from the photosensitive drum 11.

Figure 2:
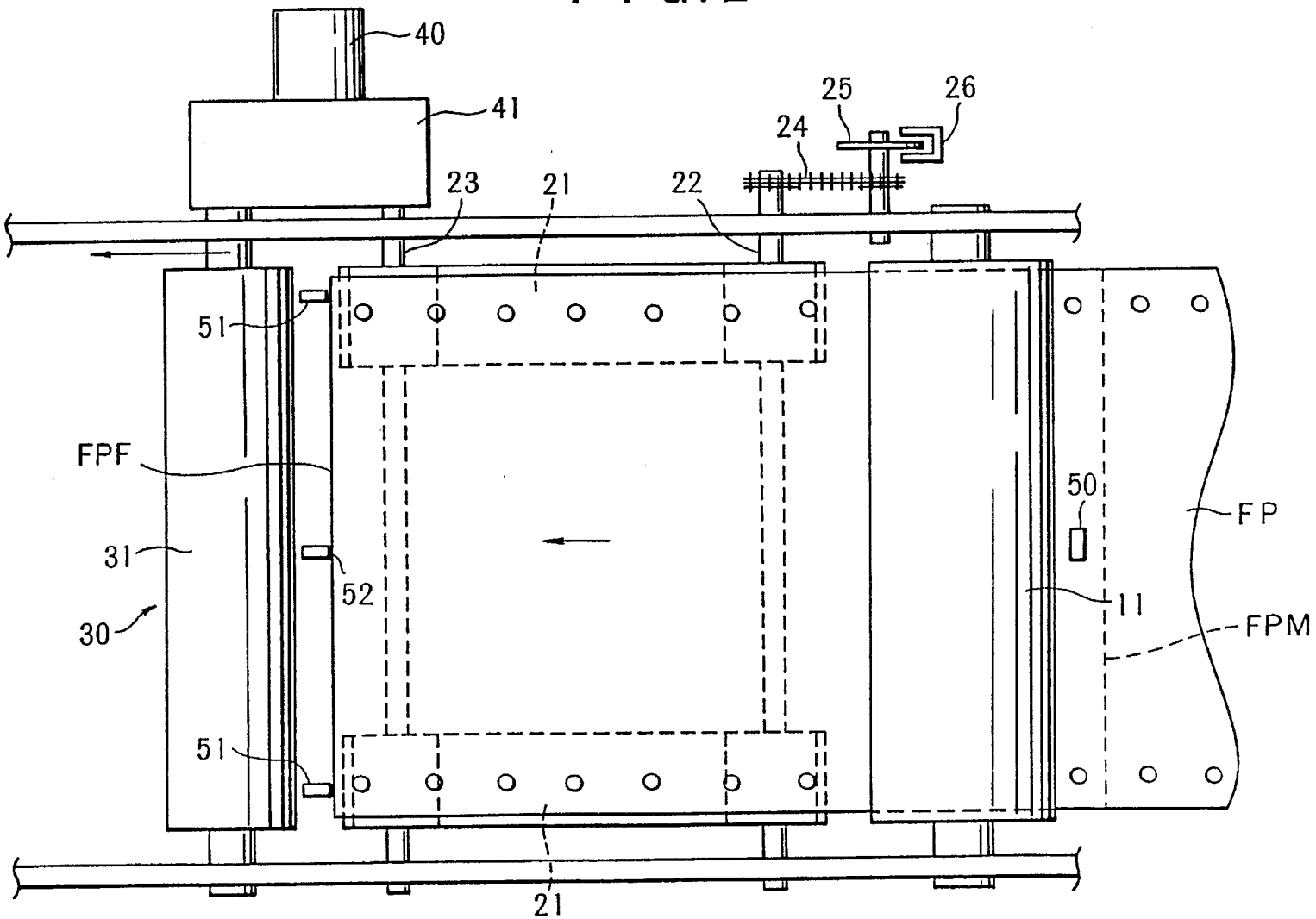
FIG. 2 is a plane view of a form feeding unit of the embodiment of FIG. 1.

As shown in FIG. 2, tractor unit 20 is constructed in such a manner that two endless belts 21, 21 wound between driven shaft 22 and drive shaft 23 are driven by a main motor 40 through a feed clutch (referred to as the F clutch hereinafter) and a gear train provided in a box 41. A gear train provided between the main motor 40 and the drive shaft 23 of the tractor unit 20 includes a one-way clutch, so that the continuous form FP is fed at 50 mm/s by only the tractor unit 20. If the form is forcibly moved by, for example, pulling, at a speed higher than 50 mm/s, the one-way clutch runs idle due to a resistance engendered by this higher speed.

Figure 4:
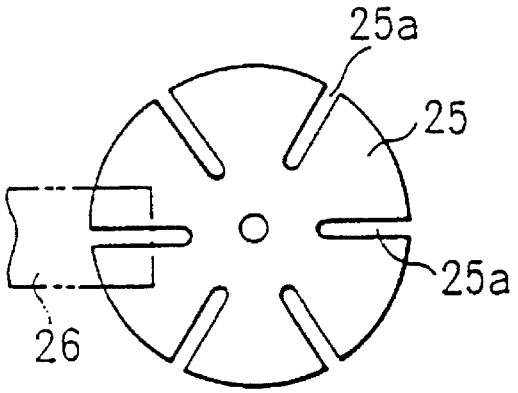
FIG. 4 is a plane view of a disk for generating a paper feed sensor (PFS) pulse.
Figure 6:
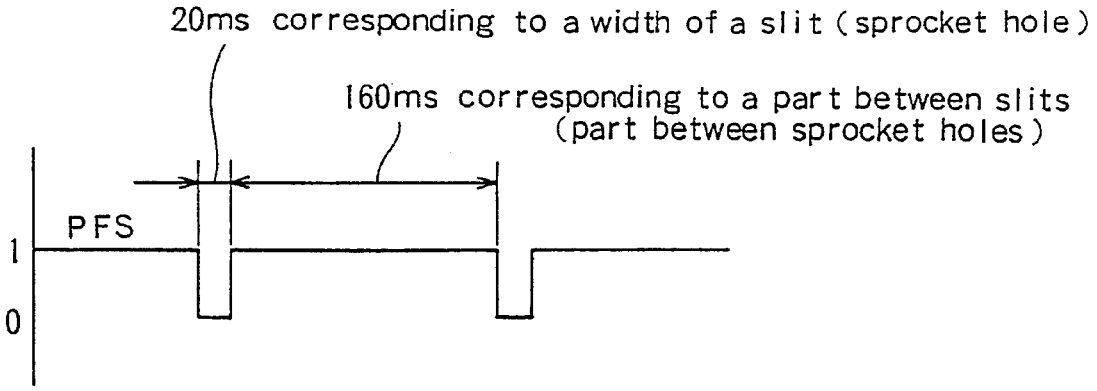
FIG. 6 is a graph showing form feeding pulses outputted from a form feed sensor.

A disk 25 is connected to the driven shaft 22 through a chain 24 and rotates in association with the driven shaft 22. As shown in FIG. 4, the disk 25 is provided with slits 25*a* at predetermined intervals. A photocoupler 26 is mounted so that it sandwiches a part of the disk 25, and outputs pulse signals when the slits 25*a* pass through the photocoupler 26, in accordance with the amount fed of the continuous form FP. Hereinafter, this photocoupler is referred to as the PFS (paper feed sensor), and the output pulse is referred to as a PFS pulse. Note that one PFS pulse is output upon the feeding of each ½ inch of the continuous form. As shown in FIG. 6, a pulse signal obtained from one of the slits 25*a* corresponds to a sprocket hole provided in the continuous form FP, and is shown as "0" in the drawing. A signal obtained by a part other than the slits 25*a* corresponds to a part other than the sprocket holes, and is shown as "1" in the drawing.

The fixing unit 30 is provided with an upper heat roller 31 and a lower press roller 32. The heat roller 31 includes a halogen lamp for heating and a thermistor for sensing a temperature. The press roller 32 is provided for pressing the continuous form FP passing through the rollers 31 and 32 against the heat roller 31 with a predetermined pressure. The heat roller 31 is rotated by the main motor 40 through the F clutch and a gear train, and feeds the continuous form FP at a speed of 75 mm/s between the rollers 31 and 32. Therefore, the actual feeding of the continuous form FP is carried out by the fixing unit 30, and the tractor unit 20 acts to impose a rearward tension to the continuous form FP, to prevent a skewing thereof, and an offset or zigzag movement of the continuous form FP.

The printer is provided with three kinds of sensors along a feeding passage of the continuous form FP, to sense whether or not the continuous form FP is present in the feeding passage.

First, an empty sensor 50 is provided between the inlet mouth 1 and the transfer unit 10. In this printer, perforated portions, which are boundaries between two adjacent pages, are positioned immediately below the sensitive drum 11 of the transfer unit 10 and at the fixing rollers 31 and 32, respectively, when a printing process is stopped. Therefore, when the continuous form ends at that page, the printer senses the end of continuous form through a signal output by the empty sensor 50.

Second, skew sensors 51, 51 are provided between the fixing unit 30 and the tractor unit 20 and in contact with the edges of the continuous form FP, to thereby sense a skewing and breaking of the continuous form PP. These skew sensors output a signal when at least one of the edges of the continuous form FP has risen.

Third, a tip sensor 52 is provided between the two skew sensors 51 and 51. This tip sensor 52 senses a tip portion FPF of the continuous form FP when a positioning of the continuous form FP is carried out.

As it takes time to heat the heat roller 31 from a room temperature to a temperature necessary for the fixing, the heat roller 31 is heated while waiting for the start of a next printing operation. Note that, since the continuous form FP is used in this printer, if the continuous form FP is always in contact with the heat roller 31, burning or blistering of the paper may occur. Therefore, the press roller 32 facing the heat roller 31 is constructed to be able to move up and down, so that the press roller 32 can be moved down and thus separated from the continuous form FP when waiting for the start of a next printing operation.

Both ends of the press roller 32 are supported by arms 33 rotatably fixed to the chassis of the printer through a pivot L2. The arms 33 are connected to a lever 34 by a tension spring 35, and the lever 34 is rotatably fixed to the chassis of the printer through the pivot L2, similar to the arms 33. The lever 34 is provided with a cam follower 34*a* at a tip portion thereof, and this cam follower 34*a* engages with a cam 36 and is swung up and down by a rotation of the cam 36, so that the lever 34 and arms 33 move up and down to move the press roller 32 up and down. The downward movement of the press roller 32 is generated by the dead-weight thereof.

Note that the up and down movements of the press roller 32 and the up and down movements of the electrical discharge unit 15 are carried out by the same driving means, as described below.

Figure 3:
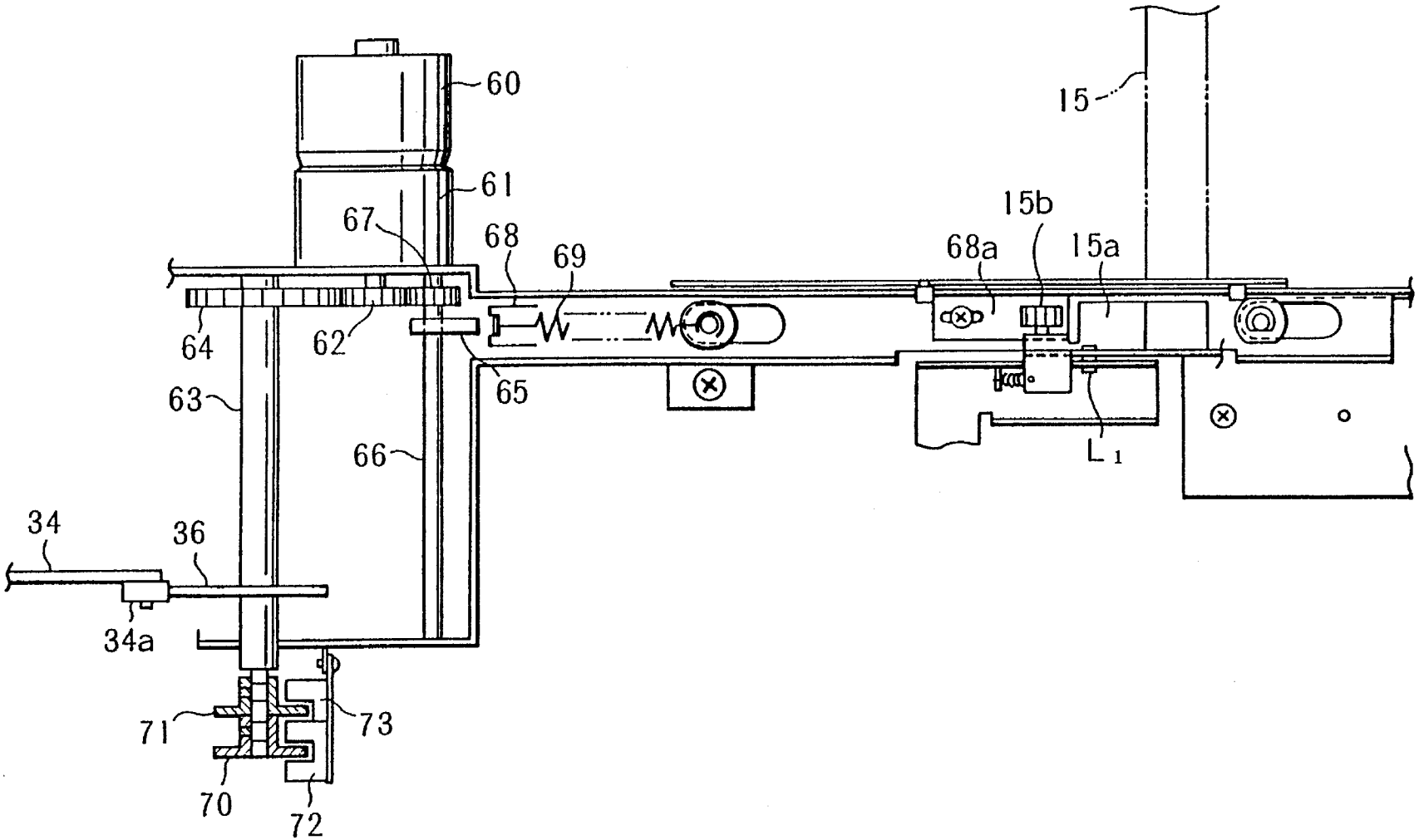
FIG. 3 is a sectional view of a part near a backup (BR) motor.

The drive source is a backup roller motor (referred to as a BR motor hereinafter) 60 provided under the feeding passage of the continuous form FP as shown in FIG. 3. A gear 62 driven by the BR motor 60 through a reduction mechanism 61 meshes with a gear 64 connected to the shaft 63 to which the cam 36 is fixed at one portion thereof, and meshes with a gear 67 connected to a shaft 66 to which a lever 65 moving the electrical discharge unit 15 up and down is fixed at another portion thereof.

The lever 65 is connected to a slide plate 68 which is slidable relative to the chassis of the printer. The slide plate 68 is urged to the left in the drawing by a tension spring 69. When the slide plate 68 is slid to move against a spring force of the tension spring 69, a plate cam 68*a* provided at the end of the slide plate 68 comes into contact with the cam follower 15*b*, to move the electrical discharge unit 15 down.

Figure 5A:
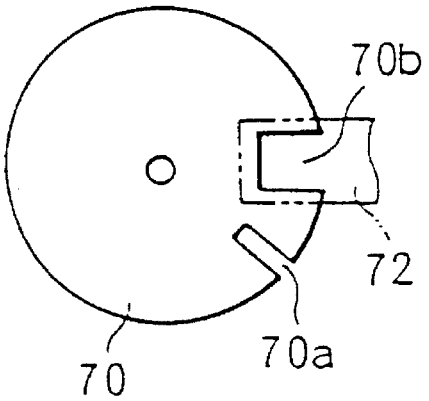
FIG. 5(A) is a plane view of a disk and a photocoupler outputting backup roller (BRUU and BRUU') signals.
Figure 5B:
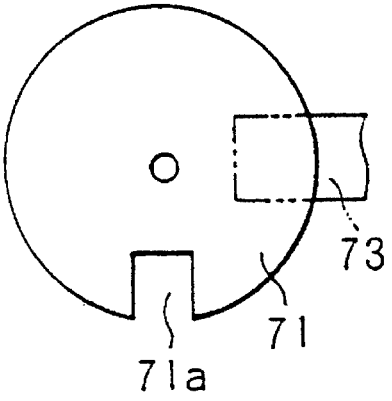
FIG. 5(B) is a plane view of a disk and a photocoupler outputting a backup roller down (BRD) signal.

Two disks 70 and 71 are fixed to the shaft 63 to rotate as one body. Outside disk 70 is provided with a small slit 70*a* and a large slit 70*b* as shown in FIG. 5(A), and inside disk 70*b* is provided with a slit 71*a*, as shown in FIG. 5(B). These disks 70 and 71 are disposed in such a manner that parts of the disks are positioned at gaps in the photocouplers 72 and 73, respectively. The disks 70 and 71 and the photocouplers 72 and 73 together construct sensors for sensing a position of the press roller 32. Note that, in the following description, a backup roller up signal (BRUU signal and BRUU' signal) and a backup roller down signal (a BRD signal) are output from the photocouplers 72 and 73. The BRUU signal is used for taking a timing of an exposure, the BRUU' signal is used for sensing a state in which the press roller 32 is moved up, and the BRD signal is used for sensing a state in which the press roller 32 is moved down.

The press roller 32 is positioned at a down position except when a printing process is carried out, whereby an unnecessary contact thereof with the continuous form FP is completely avoided. Therefore, when the printer is stopped due to the occurrence of errors, the press roller 32 is always retracted; i.e., moved down.

Figure 7:
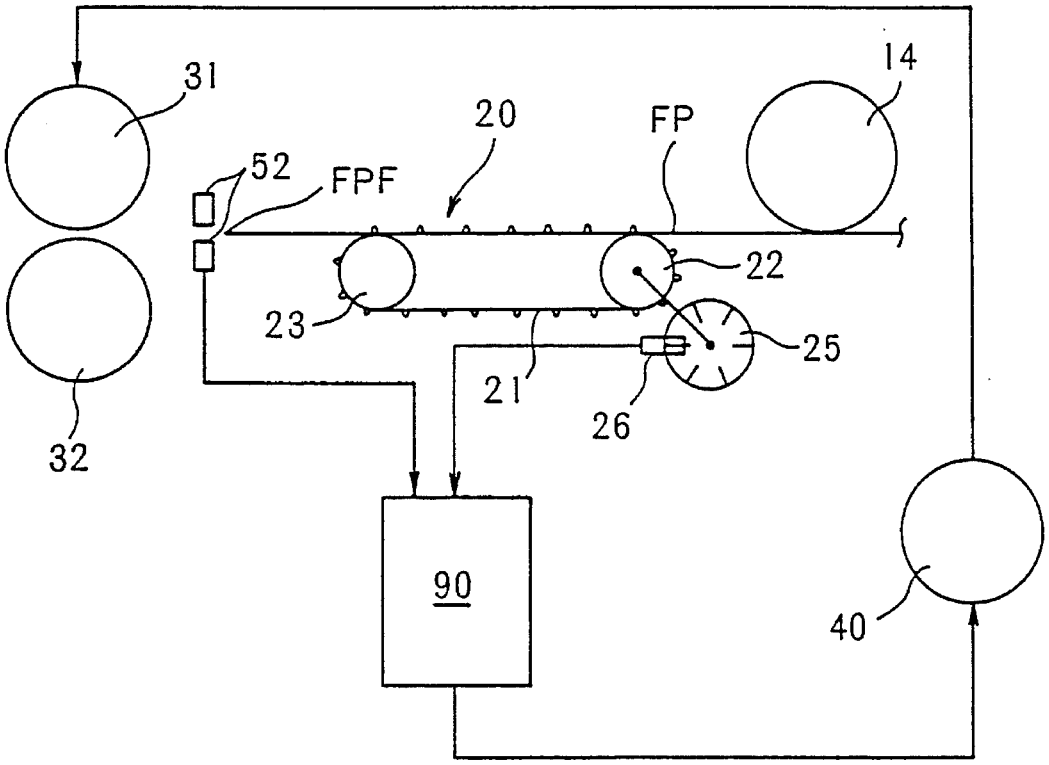
FIG. 7 is a schematic view of a device for positioning a tip portion of a continuous form, according to an embodiment of the present invention.

A main CPU 90 of the laser printer 1 is described below with reference to FIG. 7.

Figure 8:
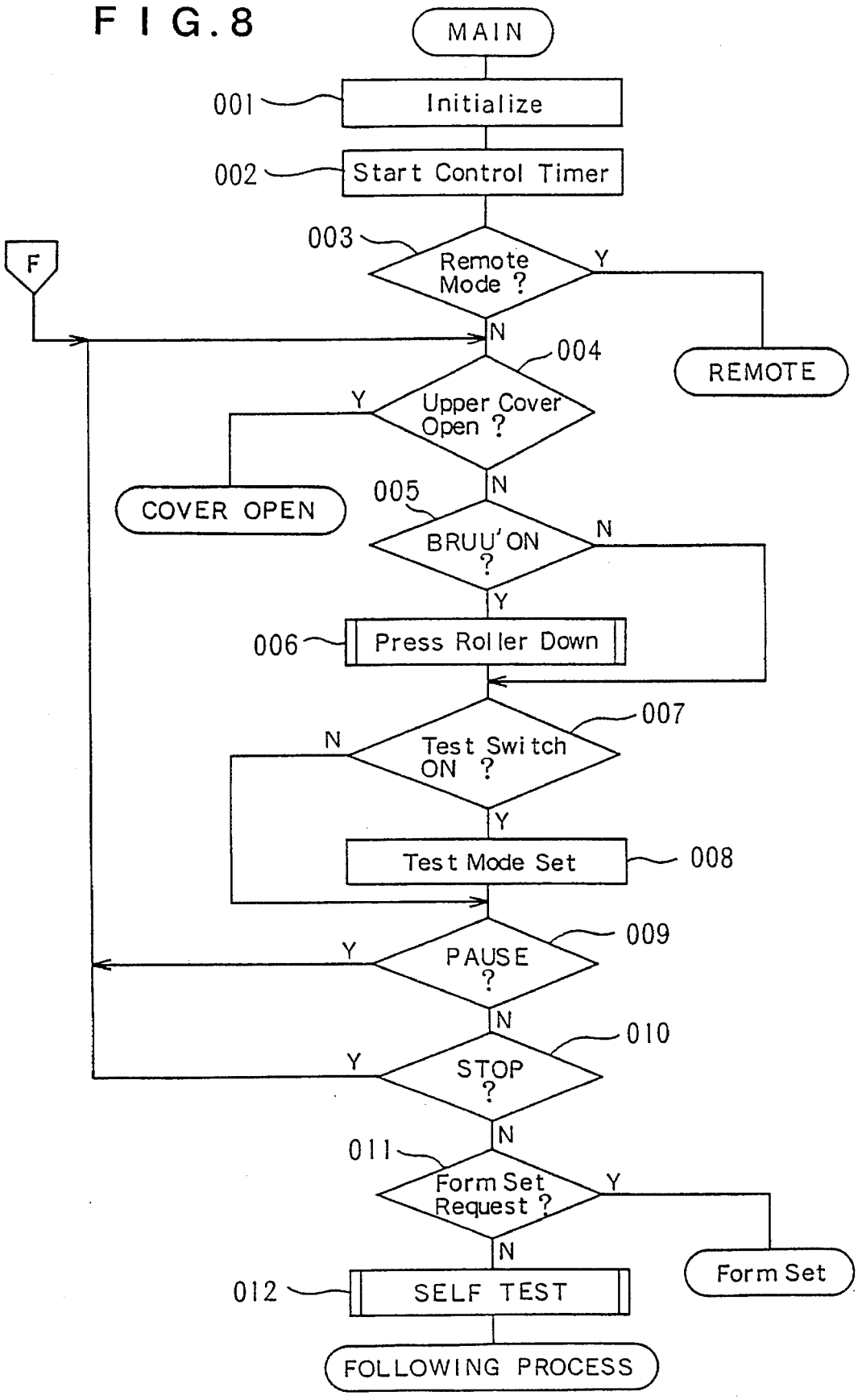
FIG. 8 is a flow chart of a main routine.

The main CPU 90 is provided with functions by which various operations are carried out at predetermined timings, and the main CPU 90 carries out these processes in accordance with a main routine shown by the flow chart of FIG. 8. This flow chart deals mainly with a positioning of the tip portion of the continuous form, and other processes relating to the actual printing, etc., are omitted.

The main CPU 90 determines whether or not a positioning of the tip portion of the continuous form is needed, based upon an output of the tip sensor 52, and when the positioning of the tip portion is needed, the main CPU 90 rotates the rollers of the fixing unit 30 while counting the number of PFS pulses output, until substantially one page of the continuous form is fed, and then stops the rotation of the fixing rollers. Namely, the main CPU 90 operates as a control means for determining the need for, and carrying out, the positioning of the tip portion of the continuous form. The operation of the main CPU 90 is described below in detail.

FIG. 8 is a flow chart of the main routine. When a power supply is inputted, the main CPU 90 initializes the registers for preparing a printing process in STEP 001, and starts a control timer in STEP 002. The control timer is used, for example, for defining a width of a drive pulse of the main motor 40.

Then, in STEP 003, the main CPU 90 determines whether or not a remote controller (not shown) is connected. The remote controller is provided for controlling the laser printer from outside of the printer, and is used for monitoring the operation of the printer and detecting faults occurring in the printer. In this explanation, it is assumed that the remote controller is not connected to the printer, and therefore, the process proceeds to STEP 004.

In STEP 004, it is determined whether or not the upper cover 19 is open. If the upper cover is open, the process goes to a cover open routine. Note that when a new continuous form FP is set in the printer, the setting is carried out while the cover 19 is open; here it is assumed that the cover 19 is closed, and thus the process proceeds to STEP 005 in which it is determined whether or not the press roller 32 has been moved up.

Figure 10:
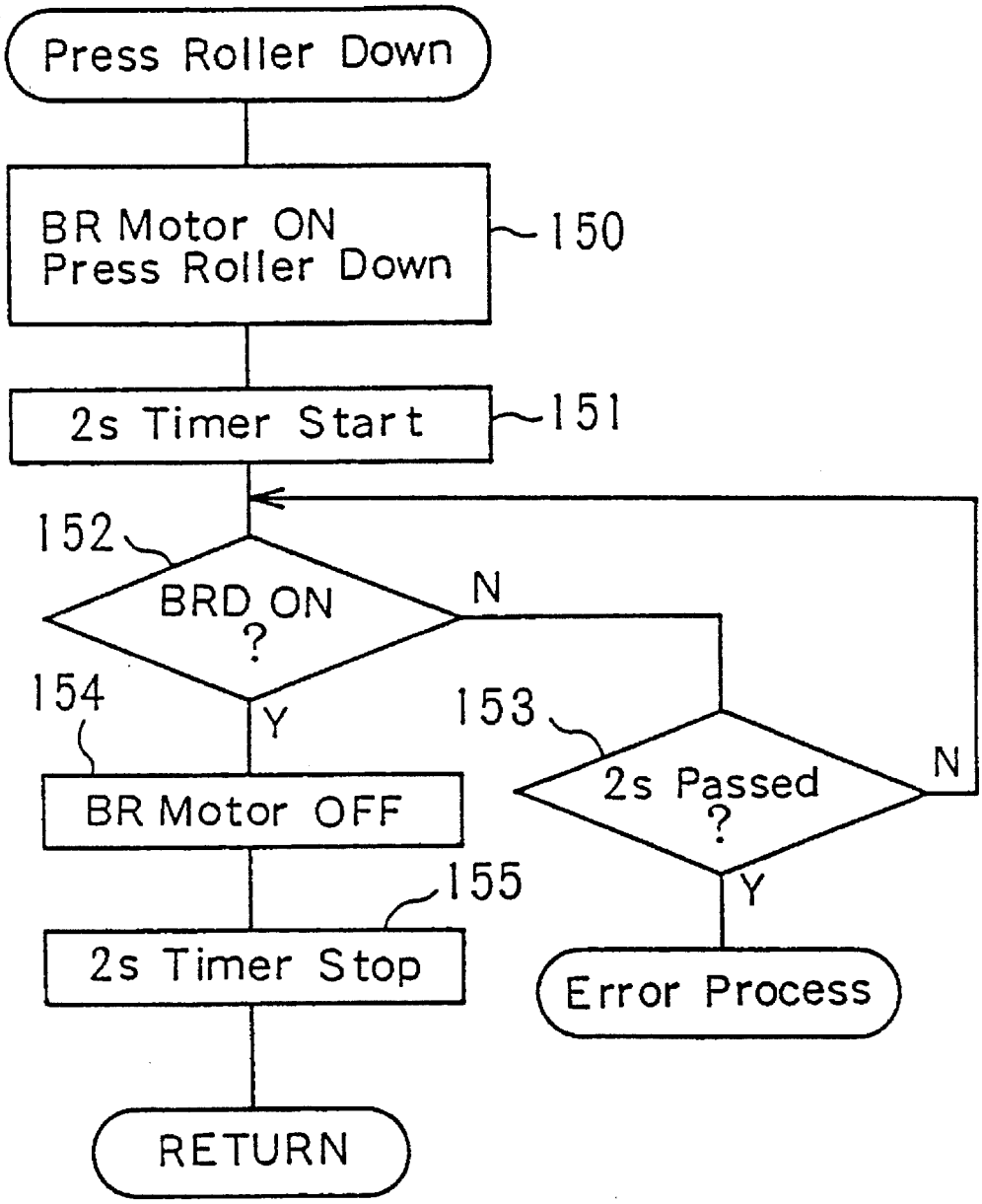
FIG. 10 is a flow chart of a press roller down routine.

If the BRUU' signal is ON, i.e., if the press roller 32 is in the up position, a press roller down routine shown in FIG. 10 is requested in STEP 006, and the press roller 32 is moved down. This state may occur when the power supply is cut during a printing process and the press roller is left at the up position. The process for moving the press roller down is carried out to prevent a burning of the continuous form when the heater is turned ON at the start of the next printing process.

Figure 9:
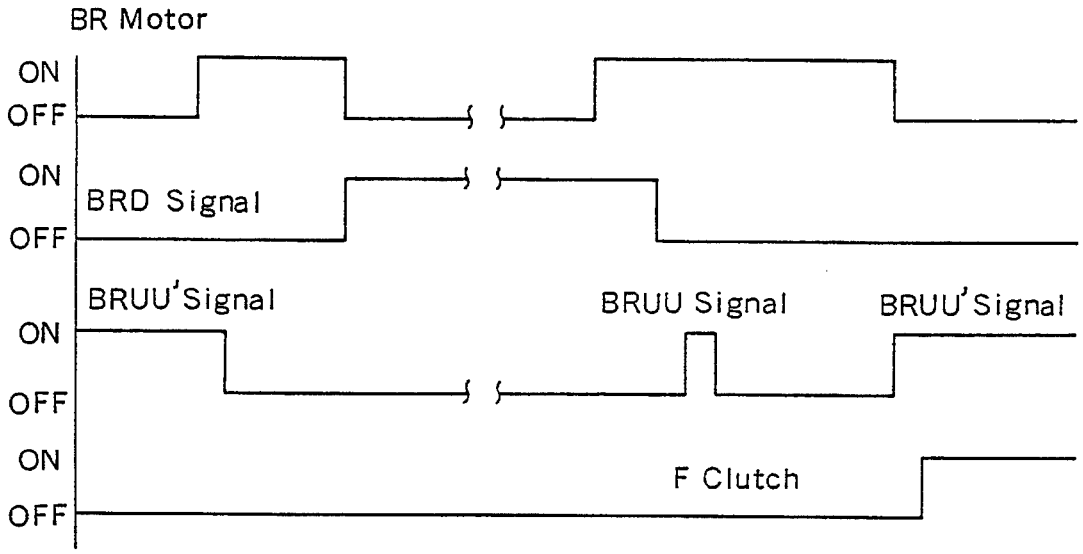
FIG. 9 is a graph showing a timing of the BR motor, BRD signal, BRUU signal, BRUU' signal and an F clutch.

In the press roller down routine shown in FIG. 10, in STEP 150 the BR motor is driven in a direction in which the press roller 32 is moved down, and in STEP 151, a 2 second timer is started. Before the operation of the 2 second timer is completed, it is determined in STEP 152 and 153 whether or not the Bled signal (see FIG. 9) has become ON. If the BRD signal has not become ON within 2 seconds, the process goes to an error processing routine. Conversely, if the BRD signal has become ON within 2 seconds, the process goes to STEP 154 in which the BR motor is stopped, goes to STEP 155 in which the timer is stopped, and then returns to STEP 007 in FIG. 8. Note that, in the error processing routine, the kind of error that has occurred is indicated, and the power supplies for the motor and heater are turned OFF, whereby the operation of the printer is stopped.

In STEP 007, the main CPU 90 determines whether or not a test switch of the laser printer is turned ON. If the test switch is turned ON, the process goes to STEP 008 in which a test mode process is carried out, and then in STEP 012, a self test (a self-diagnosis test) is carried out. Since the test mode has no connection with the present invention, it is assumed that the process does not carry out STEP 008 and goes directly to STEP 009.

In STEP 009, it is determined whether or not a pause request has been inputted. The pause request is input only when a toner shortage or overflows occurs, and is not input in any other case. Here, it is assumed that a shortage or overflow of toner has not occurred, and thus the process goes to STEP 010, in which it is determined whether or not a stop request by which the laser printer is immediately stopped, has been input. Namely, the pause request and the stop request are distinguished from each other because, when a toner shortage or overflow occurs, there is no need for an immediate stopping of the laser printer, i.e., when a shortage or overflow of the toner occurs during printing, preferably printed image transfer to and fixing of one page of the continuous form are completed.

In STEP 010, if a stop request has not been received, the process goes to STEP 011, in which it is determined whether or not a positioning of a tip portion of the continuous form has been requested.

As shown in FIG. 4, the positioning of the tip portion of the form is requested when the tip portion FRF of the continuous form FP has not passed through the tip sensor 52. When this request is received, the main CPU 90 carries out a form setting process as shown in FIGS. 11*a* and 11*b*.

Figure 11A:
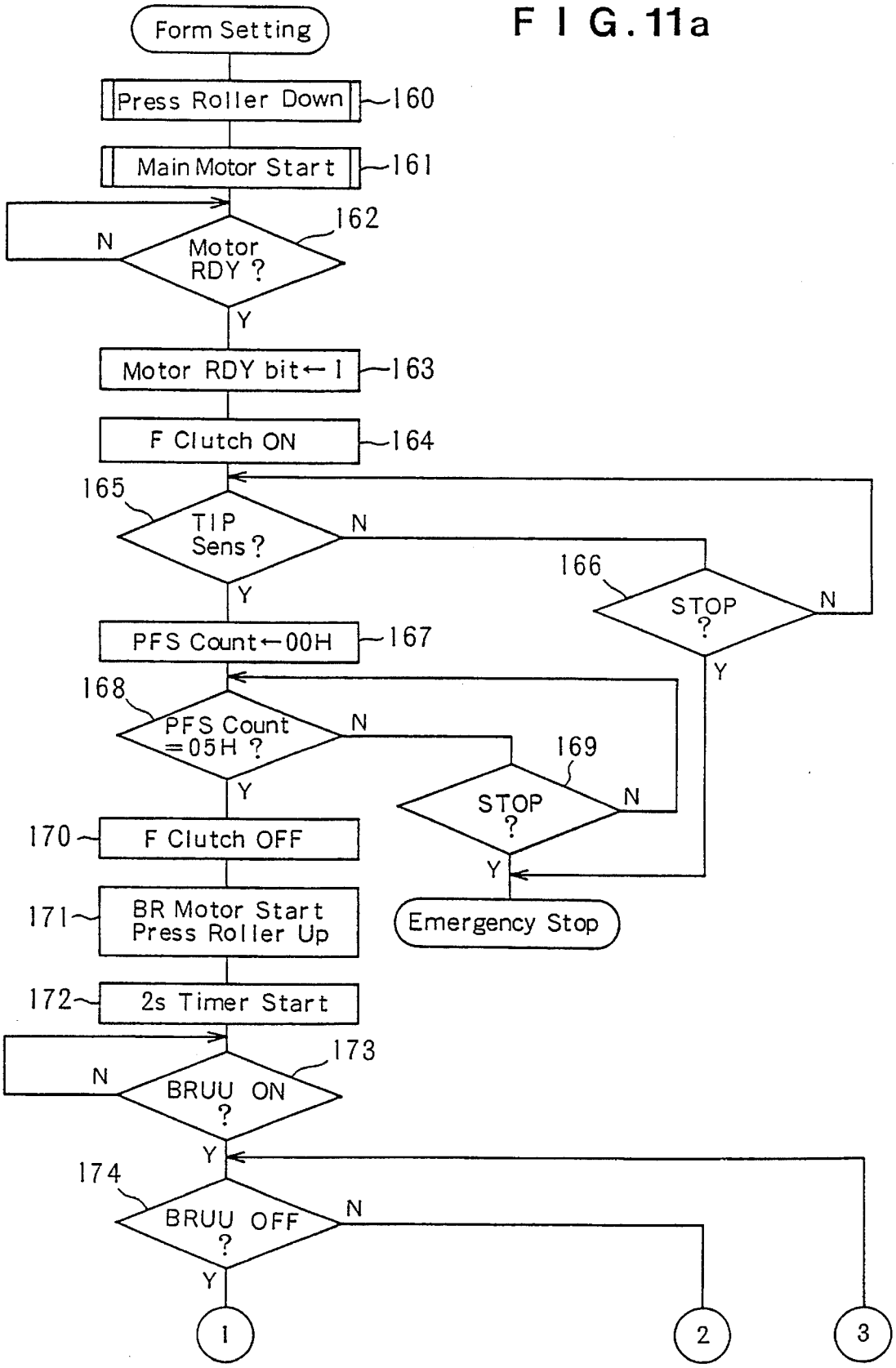
FIGS. 11*a* and 11*b* illustrate a flow chart of a form setting routine.
Figure 11B:
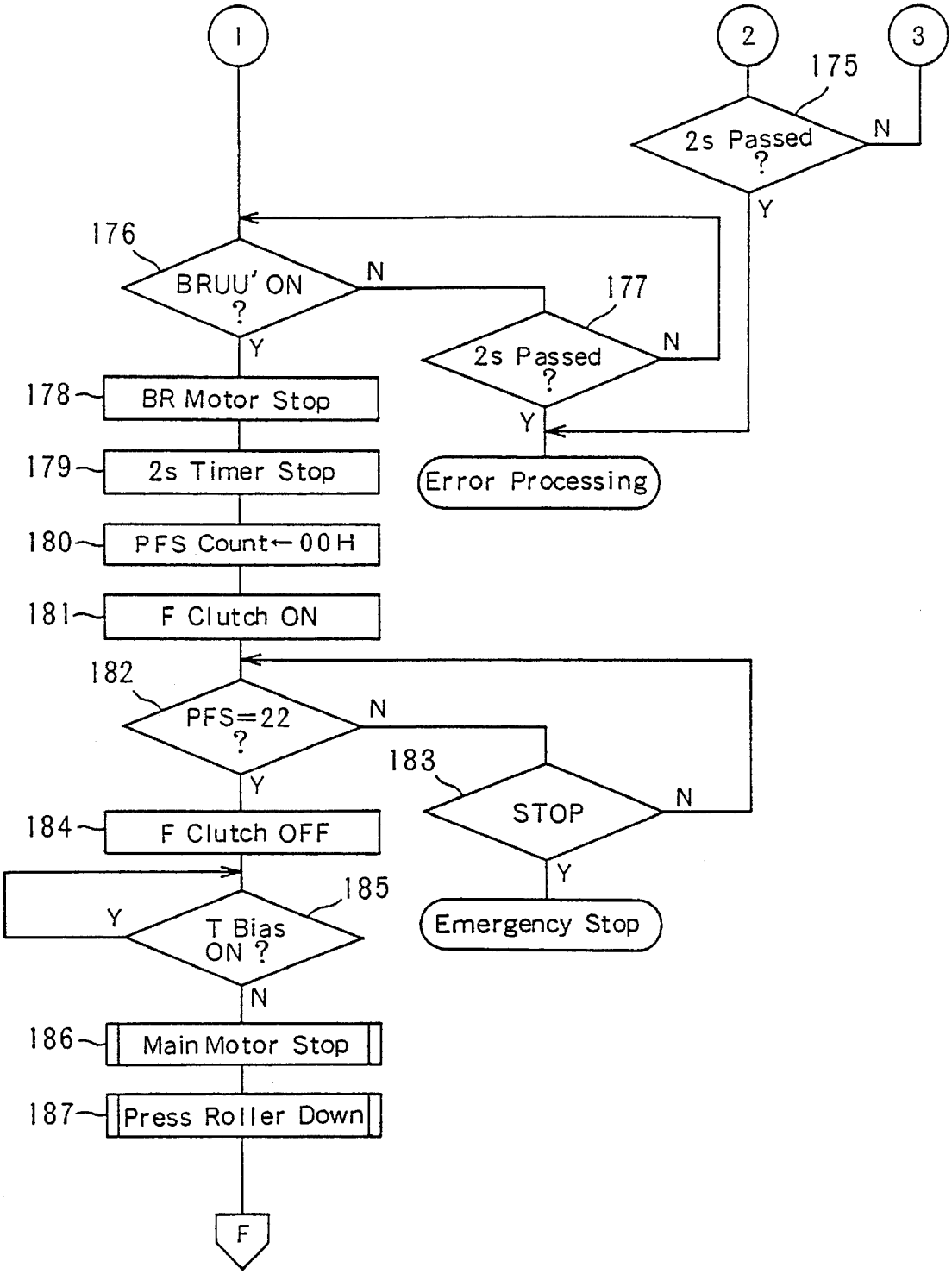

In the form setting routine shown in FIG. 11*a*, the press roller down routine shown in FIG. 10 is carried out in STEP 160, and a main motor start routine is requested in STEP 161.

Figure 12:
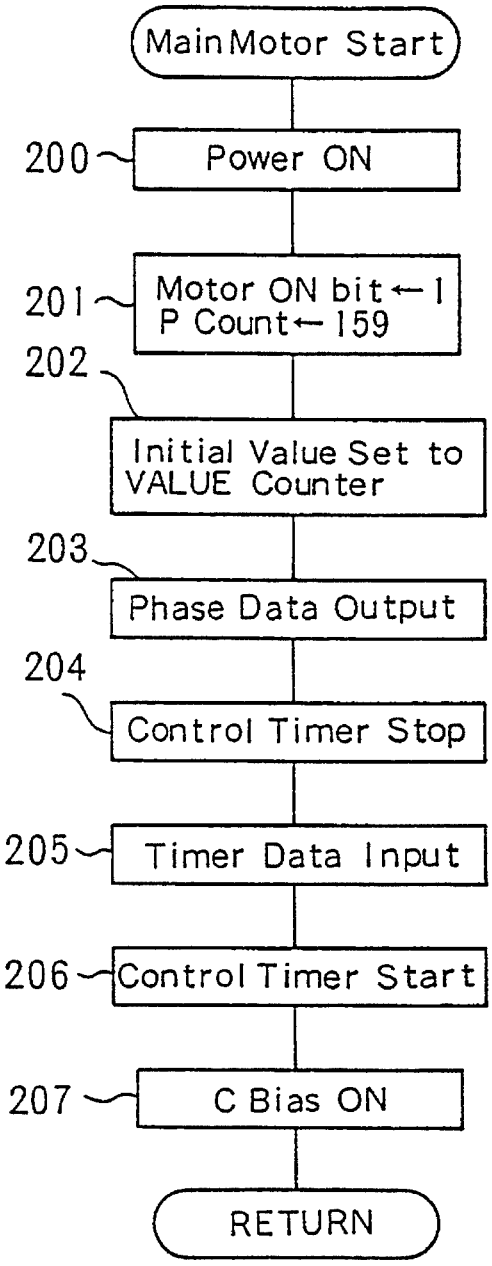
FIG. 12 is a flow chart of a main motor driving routine.

In the main motor start routine as shown in FIG. 12, a power supply is switched ON in STEP 200, a motor ON bit is set to "1" and a P counter is set to "159" in STEP 201, and an initial value is set to a VALUE counter in STEP 202. The P counter is used in a timer interrupt routine described later to set data for starting the motor, so that a rotation of the main motor 40 is accelerated from a slow speed to a high speed. The VALUE counter is a counter to which data corresponding to a frequency of the actual drive pulse when starting the main motor 40 is set. Since the acceleration process of the main motor 40 has no connection with the present invention, a decription thereof is omitted.

In STEP 203, phase data of a drive pulse for the main motor is output in accordance with data set in the VALUE counter, the control timer is stopped in STEP 204, the timer data is input in STEP 205, and the control timer is started again with the set value in STEP 206. Finally, the C bias of the cleaning brush 16 is turned ON in STEP 207, and the process then returns to a step at which the main motor start routine was carried out, i.e., in this case, STEP 162 shown in FIG. 11*a*.

If it is determined in STEP 162 that a rotation of the main motor 40 has reached a predetermined value, a motor RDY bit is set to "1" in STEP 163. If the main motor 40 has been stopped, the motor RDY bit is set to "0".

The process then goes to STEP 164, in which the F clutch is connected, whereby the heat roller 31 and the endless belts 21 of the tractor unit 20 are rotated, and the feeding of the continuous form FP is started by the endless bells 21.

Then, in STEPS 165 through 169, the process waits until the form is fed by 5 PFS pulses from an input of a signal by the tip sensor 52. Namely, if it is determined that the tip sensor 52 has sensed the tip portion FPF of the continuous form FP in STEP 165, a PFS count is set to "00H" in STEP 167, and it is determined whether or not the PFS count has reached "05H" in STEP 168. If it is determined that the PFS count has reached "05H" in STEP 168, the process goes to STEP 170. Accordingly, when the form is fed by 5 pulses, i.e., 2.5 inches, after a signal has been inputted from the tip sensor 52, the tip portion of the continuous form is engaged with the rollers of the fixing unit 30, and a perforated portion FPM (see FIG. 2), which is a boundary between two adjacent pages, is positioned immediately under the sensitive drum 11.

In STEPS 165 through 169, it is also determined whether or not a STOP signal has been inputted, and if the STOP signal is input before the continuous form is fed by 5 pulses after sensing the tip portion of the continuous form, the process goes to an emergency stop routine. If a STOP signal is not inputted during the sensing of 5 pulses by the PFS, the process goes to STEP 170, in which the F clutch is shut off.

At this time, due to the process carried out in STEPS 165 through 170, the tip portion FPF of the continuous form FP is positioned under the heat roller 31 of the fixing unit 10 and is sandwiched between the rollers 31 and 32, and therefore, the feeding of the continuous form FP can be started. If the heat roller 31 is kept at a high temperature while waiting for a next printing operation to start, however, even if the tip portion of the continuous form FP is not sandwiched by the rollers 31 and 32, heat radiated by the heat roller 31 causes curling and a change of the quality of the continuous form, and as a result, when the press roller 32 is moved up to start a feeding of the continuous form, the tip portion of the continuous form is not properly fed between the rollers 31 and 32, and thus a paper jam occurs.

To avoid this problem, one page of the continuous form FP is discharged from the printer by a process carried out in STEPS 171 through 184 described below.

First, the press roller 32 is moved up to sandwich the form together with the heat roller 31 in STEPS 171 through 179. In this process, the BR motor is rotated in a direction in which the press roller 32 is moved up in STEP 171, and a 2 second timer is started in STEP 172. Then, before the operation of the 2 second timer is completed, it is determined whether or not the press roller 32 is moved up to a predetermined position, and, in STEP 173, it is determined whether or not a BRUU signal has been outputted, i.e., whether or not the first slit 70*a* (FIG. 5(A)) is at the photocoupler 72. When the BRUU signal has been outputted, the scanning system is driven to start an exposure, and the process goes to STEP 174 in which the BRUU signal disappears. If the BRUU signal does not disappear the process goes to STEP 175, in which it is determined whether or not 2 seconds have passed since the start of the 2 second timer in STEP 172. If 2 seconds have not passed in STEP 175, the process goes to STEP 174 and waits until the BRUU signal has disappeared. If it is determined in STEP 175 that 2 seconds have passed, the process goes to the error processing process.

If it is determined in STEP 174 that the BRUU signal has disappeared during the 2 second period, the process goes to STEP 176, in which it is determined whether or not a BRUU' signal has been outputted. The BRUU' signal corresponds to the second slit 70*b* (FIG. 5(A)), and an output of the BRUU' signal means that the press roller 32 has been moved up to the predetermined position thereof.

If the BRUU' signal is not outputted in STEP 176, it is determined in STEP 177 whether or not 2 seconds have passed since the start of the 2 second timer in STEP 172. If it is determined in STEP 177 that 2 seconds have passed, it is determined that the BR motor has malfuntioned and the error processing routine is carried out. If the BRUU' signal is outputted during the 2 second period, the process goes from STEP 176 to STEP 178, in which the BR motor 60 is stopped, and the 2 second timer is stopped in STEP 179. Then, a process by which one page of the continuous form is discharged, is carried out as described below.

A counter counting the PFS pulses is cleared in STEP 180, and the F clutch is connected in STEP 181 to start the feeding of the continuous form. In this printer, the continuous form is fed by one page having a length of 11 inches, and 22 PFS pulses correspond to one page.

Accordingly, while it is determined whether or not the STOP signal has been inputted in STEP 133, it is also determined whether or not the PFS pulses have been sensed 22 times in STEP 182. If 22 PFS pulses have been sensed in STEP 182, the F clutch is disconnected in STEP 184 to stop the feeding of the continuous form. By this process, the first page of the continuous form is discharged from the outlet of the printer, whereby a boundary between the first page and the second page is positioned at the fixing unit 30 and a boundary between the second page and the third page is positioned immediately under the photosensitive drum 11.

Although, in STEP 185 it is determined whether or not the T bias of the developing unit 14 is turned ON, when the tip portion of the continuous form is positioned, the T bias is turned OFF. Therefore, in this case, the process immediately goes from STEP 185 to STEP 186, in which a main motor stop process is requested, and thus the main motor 40 is stopped. Then the press roller 32 is moved down in STEP 187, so that a pressure on the continuous form exerted by the roller 32 is released, and the process goes to STEP 004 in FIG. 8.

Figure 13:
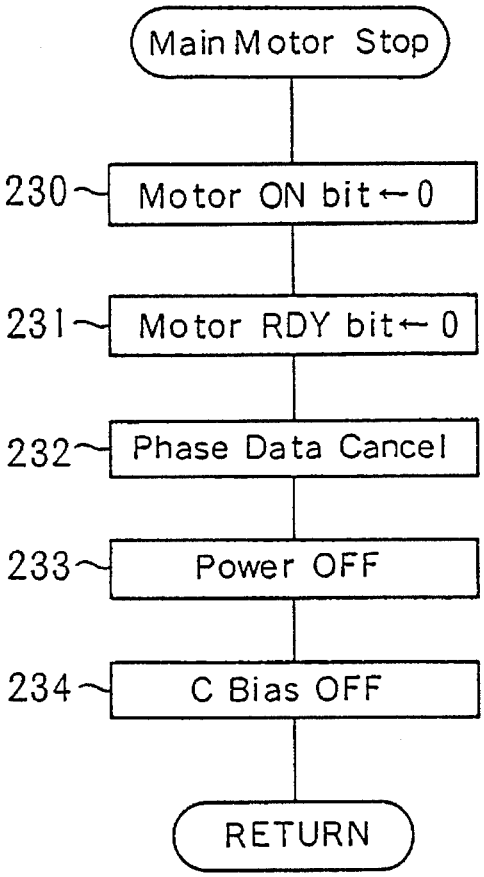
FIG. 13 is a flow chart of a main motor stopping routine.

The main motor stop routine is carried out as shown in FIG. 13. Namely, in STEPS 230 and 231, a motor ON bit and a motor RDY bit are cleared to "0", respectively, and phase data for driving the motor is cancelled in STEP 232. Then, a power supply for the motor is turned OFF in STEP 233, the C bias is turned OFF in STEP 234, and the process returns to STEP 186 of the form setting routine at which this main motor stop routine was requested.

When the continuous form setting routine has been carried out, and accordingly, a request for the form to be set is not received at STEP 011, the self test routine is carried out in STEP 012. In this routine, if an error is detected, the process goes to the error processing routine. Note that this self test routine is used at a start of a usual printer operation.

Although the embodiments of the present invention have been described herein with reference to the accompanying drawings, obviously many modifications and changes may be made by those skilled in this art without departing from the scope of the invention.

We claim:

1. A device for positioning a tip portion of a continuous form when said continuous form is set in a laser printer, said laser printer having a photosensitive drum on which a printed image is exposed and which transfers said printed image to said continuous form, said device comprising:

a pair of fixing rollers feeding said continuous form, said fixing rollers being provided at a position separated by a predetermined interval from said photosensitive drum along a path along which said continuous form is fed by said fixing rollers, wherein said predetermined interval is equal to a page length of said continuous form;

a tip sensor, located between said photosensitive drum and said pair of fixing rollers, for sensing a tip portion of said continuous form, said tip sensor outputting a signal indicative of a position of said continuous form;

means for feeding said continuous form, said feeding means being provided between said photosensitive drum and said fixing rollers;

a feed sensor for sensing a predetermined amount of said continuous form that has been fed and having means for outputting feeding pulses, a portion of said feed sensor being rotated by movement of said continuous form in response to said feeding means to output said feeding pulses, wherein said means for outputting said feeding pulses outputs one of said feeding pulses for each said predetermined amount of feeding of said continuous form, and wherein a number of said feeding pulses equal a value for measurement of a feeding distance of said continuous form after said tip sensor detects said continuous form; and means for controlling said fixing rollers, said control means controls said fixing rollers by rotating said pair of fixing rollers in response to said output signal of said tip sensor, and then stopping said rotation of said fixing rollers in response to a number of said feeding pulses equal to a value for measurement of one said page length of said continuous form.

2. A device according to claim 1, wherein said fixing rollers feed said continuous form therebetween.

3. A device according to claim 2, wherein said fixing rollers comprise a heat roller provided for heating said continuous form and a press roller provided for pressing said continuous form passing through said fixing rollers against said heat roller with a predetermined pressure.

4. A device according to claim 1, wherein said feeding means has a driven shaft, a drive shaft, said drive shaft driven by a motor, an endless belt looped around said driven shaft and said drive shaft and engaged with said continuous form, said belt driving said driven shaft, and a one-way clutch mounted on said drive shaft, wherein said continuous form is fed by said feeding means at a speed that is lower than a feeding speed of said fixing rollers.

5. A device according to claim 1, wherein said feed sensor comprises a disk rotated by a shaft and provided with slits at predetermined intervals, and wherein said means for outputting said feeding pulses comprises a photocoupler arranged to sandwich a part of said disk to output said feeding pulses when said slits pass through said photocoupler, in accordance with an amount fed of said continuous form.

6. A device according to claim 1, wherein said tip sensor is provided upstream of said fixing rollers with respect to a feeding direction of said continuous form.

7. A device according to claim 1, wherein said control means determines that said tip portion of said continuous form needs positioning when said tip sensor can not sense said tip portion.

8. A device according to claim 1, wherein said fixing rollers feed said continuous form to a position immediately under said photosensitive drum, said continuous form having pages, each of said pages having a first end and a second end, each of said ends having perforations, wherein perforations at an end of one of said pages of said continuous form are positioned immediately under said photosensitive drum and perforations at another end of said one of said pages of said continuous form are positioned immediately under one of said fixing rollers.

9. A device for positioning a tip portion of a continuous form provided in a laser printer, said laser printer having a photosensitive drum on which a printed image is exposed and which transfers said printed image to said continuous form, said device comprising:

a pair of rollers feeding said continuous form, said rollers being provided near an outlet mouth of said laser printer at a distance from said photosensitive drum which equals one page length of said continuous form;

means for applying a tension to said continuous form, said tensioning means being provided upstream of said rollers with respect to a feeding direction of said continuous form;

a feed sensor for sensing a predetermined amount of said continuous form that has been fed and having means for outputting feeding pulses, a portion of said feed sensor being rotated by movement of said continuous form in response to said feeding means, in association with said tensioning means, to output said feeding pulses, wherein said means for outputting said feeding pulses outputs a feeding pulse each said predetermined amount of feeding of said continuous form passes said feed sensor, wherein a number of said feeding pulses equal a value representative of a length of said continuous form that has been fed;

a tip sensor, located between said photosensitive drum and said pair of rollers, for sensing a tip portion of said continuous form, said tip sensor outputting a signal indicative of a position of said continuous form;

means for controlling said rollers in response to said output signal of said tip sensor and said feeding pulses; and means for preliminary feeding of a preliminary amount of said continuous form prior to controlling said rollers in response to said feeding pulses until said tip sensor detects said continuous form;

wherein said control means controls said rollers by rotating said pair of rollers in response to said output signal of said tip sensor, and then stopping said rotation of said rollers in response to a number of said feeding pulses equal to a value representative of one said page length of said continuous form, to discharge a page length of said continuous form from said rollers.

10. A device according to claim 9, wherein said rollers feed said continuous form therebetween.

11. A device according to claim 9, wherein said tensioning means comprises a driven shaft, a drive shaft, said drive shaft driven by a motor, an endless belt looped around said driven shaft and said drive shaft and engaged with said continuous form, said belt driving said driven shaft, and a one-way clutch mounted on said drive shaft, so that said tensioning means drives said continuous form by applying tension thereto, wherein said continuous form is driven by said tensioning means at a speed that is lower than a feeding speed of said rollers.

12. A device according to claim 9, wherein said feed sensor comprises a disk rotated by a shaft and provided with slits at predetermined intervals, and wherein said means for outputting said feeding pulses comprises a photocoupler arranged to sandwich a part of said disk to output said feeding pulses when said slits pass through said photocoupler, in accordance with an amount fed of said continuous form.

13. A device according to claim 9, wherein said tip sensor is provided upstream of said rollers with respect to a feeding direction of said continuous form.

14. A device according to claim 9, wherein said control means determines that said tip portion of said continuous form needs positioning when said tip sensor can not sense said tip portion.

15. A device according to claim 9, wherein said rollers feed said continuous form to a position immediately under said photosensitive drum, said continuous form having pages, each of said pages having a first end and a second end, each of said ends having perforations, wherein perforations at an end of one of said pages of said continuous form are positioned immediately under said photosensitive drum and perforations at another end of said one of said pages of said continuous form are positioned immediately under one of said rollers.

16. A device for positioning a tip portion of a continuous form provided in a laser printer, said laser printer having a photosensitive drum on which a printed image is exposed and which transfers said printed image to said continuous form, said device comprising:

a pair of rollers feeding said continuous form, said rollers being provided near an outlet mouth of said laser printer at a distance from said photosensitive drum which equals one page length of said continuous form;

means for applying a tension to said continuous form, said means for applying tension being located upstream of said rollers with respect to a feeding direction of said continuous form;

a feed sensor for sensing a predetermined amount of said continuous form that has been fed, said sensor comprising means for outputting feeding pulses, wherein one of said feeding pulses is outputted each time said predetermined amount of feeding of said continuous form passes said feed sensor, wherein a number of said feeding pulses equal a value which represents of a length of said continuous form that has been fed;

a tip sensor, located between said photosensitive drum and said pair of rollers, for sensing a tip portion of said continuous form, said tip sensor outputting a signal indicative of a position of said continuous form;

means for controlling said rollers in response to said output signal of said tip sensor and said feeding pulses; and means for preliminary feeding of an amount of said continuous form prior to controlling said rollers in response to said feeding pulses until said tip sensor detects said continuous form;

wherein said means for controlling controls said rollers by rotating said rollers in response to said output signal of said tip sensor, and then stopping said rotation of said rollers in response to a number of said feeding pulses equal to a value representative of one said page length of said continuous form, to discharge a page length of said continuous form from said rollers.

17. A device according to claim 16, wherein said rollers feed said continuous form therebetween.

18. A device according to claim 16, wherein said means for applying tension comprises a driven shaft, a drive shaft, said drive shaft driven by a motor, an endless belt looped around said driven shaft and said drive shaft and engaged with said continuous form, said belt driving said driven shaft, and a one-way clutch mounted on said drive shaft, said tension applying means driving said continuous form by applying tension thereto, wherein said continuous form is driven by said means for applying tension at a speed that is lower than a feeding speed of said rollers.

19. A device according to claim 16, wherein said feed sensor comprises a disk rotated by a shaft, said disk having slits at predetermined intervals, and wherein said means for outputting said feeding pulses comprises a photocoupler arranged to sandwich a part of said disk to output said feeding pulses when said slits pass through said photocoupler, in accordance with an amount of said continuous form which is fed.

20. A device according to claim 16, wherein said tip sensor is provided upstream of said rollers with respect to a feeding direction of said continuous form.

21. A device according to claim 16, wherein said means for controlling is adapted to determine if said tip portion of said continuous form needs positioning when said tip sensor cannot sense said tip portion.

22. A device according to claim 16, wherein said rollers feed said continuous form to a position immediately under said photosensitive drum, said continuous form having pages, each of said pages having a first end and a second end, each of said ends having perforations, wherein perforations at an end of one of said pages of said continuous form are positioned immediately under a photosensitive drum and perforations at another end of said one of said pages of said continuous form are positioned immediately under one of said rollers.

* * * * *